US008684143B2

(12) United States Patent
Rossignol

(10) Patent No.: US 8,684,143 B2
(45) Date of Patent: Apr. 1, 2014

(54) ELEVATOR GUIDE RAIL SYSTEM

(75) Inventor: Eric Rossignol, Magadino (CH)

(73) Assignee: Inventio AG, Hergiswil (CH)

( * ) Notice: Subject to any disclaimer, the term of this patent is extended or adjusted under 35 U.S.C. 154(b) by 481 days.

(21) Appl. No.: 12/986,293

(22) Filed: Jan. 7, 2011

(65) Prior Publication Data

US 2011/0168500 A1 Jul. 14, 2011

(30) Foreign Application Priority Data

Jan. 8, 2010 (EP) ..... 10150366

(51) Int. Cl.
*B66B 7/02* (2006.01)

(52) U.S. Cl.
USPC ..... 187/406; 187/409

(58) Field of Classification Search
USPC ..... 187/406, 409; 104/127, 129
See application file for complete search history.

(56) References Cited

U.S. PATENT DOCUMENTS 1,814,610 A 7/1931 Stevelman
4,004,654 A * 1/1977 Hamy ..... 198/798
5,134,941 A 8/1992 Gortan
7,874,404 B1 * 1/2011 Adams et al. ..... 187/406
2005/0224300 A1 * 10/2005 Adifon et al. ..... 187/406

FOREIGN PATENT DOCUMENTS

ES 2204233 A1 4/2004
JP 9086832 A 3/1997
JP 2004359396 A * 12/2004 ..... B66B 11/00
WO WO 9943589 A1 * 9/1999 ..... B66B 7/02

OTHER PUBLICATIONS

JP 2004-359396 A Machine Translation.*

* cited by examiner

*Primary Examiner* — William E Dondero
*Assistant Examiner* — Diem Tran
(74) *Attorney, Agent, or Firm* — Fraser Clemens Martin & Miller LLC; William J. Clemens

(57) ABSTRACT

An elevator system has at least one common pair of guide rails for guide shoes of an elevator car, running along the common pair of guide rails, and for guiding elements of a counterweight, running along the same pair of guide rails. The guide shoes of the elevator car follow a straight trajectory and the guiding elements of the counterweight are deflectable by at least one deflecting element within a crossing region for the elevator car and the counterweight.

20 Claims, 11 Drawing Sheets

A-A

D-D

C-C

H-H

H'-H'

ELEVATOR GUIDE RAIL SYSTEM

CROSS-REFERENCE TO RELATED APPLICATION

This application claims priority to European Patent Application No. EP10150366, filed Jan. 8, 2010, which is incorporated herein by reference.

FIELD

The present disclosure relates to an elevator system with an elevator car and a counterweight movable in opposite directions along an elevator shaft or hoistway. In particular, the present disclosure relates to the guide rails and the guide shoes of the elevator car and the guiding elements of the counterweight.

BACKGROUND

Elevator systems are normally equipped with a separate pair of guide rails mounted in the elevator shaft for each of the elevator car and the counterweight to guarantee the safe and independent run of the elevator car and the counterweight. The provision of two pairs of guide rails necessarily takes up considerable space within the cross-sectional area of the shaft which could otherwise be more usefully occupied by the elevator car. Furthermore, two pairs of guide rails represent a considerable expense because of the required material, the necessary assembly and the cost of regular inspection and maintenance particularly for high-rise elevator installations.

Publication DE-A1-44 23 412 discloses a guiding arrangement with only one pair of guide rails comprising two single T-shaped rails arranged side by side so that the cross members of both T-shaped rails are aligned. The cross members of the "T"s in turn constitute an inner-located pair of guiding blades for the counterweight and an outer-located pair of guiding blades for the elevator car. Thus, although unified in T-shaped rails, this system still requires separate guide surfaces or blades for the elevator car and the counterweight respectively.

SUMMARY

Some embodiments of the disclosed technologies provide an elevator system wherein the elevator car utilizes as much of the cross-sectional area of the elevator shaft as possible. Further embodiments provide an elevator system with only one pair of guide rails with common guiding surfaces for the elevator car and the counterweight and thereby provide considerable cost savings.

The elevator car and the counterweight ride with guide shoes or guiding elements along the guide rails. The elevator car and the counterweight are interconnected and supported by suspending and driving means normally in the form of wire ropes or belts.

Some embodiments involve one pair of parallel guide rails arranged over the entire height of the elevator shaft, or over the entire amount of lifting height of the elevator system.

According to another embodiment of an elevator system, a so called rucksack-mounting-suspension of the elevator car is provided. This means that the elevator car is suspended—by pulleys or directly by the suspending and driving means—not by an under-looping arrangement, nor by a suspension point according to the center of gravity of the elevator car—but only at one side of the elevator car or only at one side of the cube elevator cars are generally forming. Regarding advantages obtained by special mounting suspensions of rucksack elevator systems, the disclosure of European application EP 08172952.7 of the same applicant is hereby incorporated into the disclosure of the present application.

Further embodiments comprise a second step by the employment of deflecting means for the guiding elements of the counterweight and/or for the counterweight itself. The elevator car runs along the pair of guide rails, without ever leaving the default straight trajectory of these guide rails. The guiding elements of the counterweight instead are deflected from this straight trajectory respectively switch or turn over the crossing guide shoes of the elevator car.

In accordance with a further embodiment of an elevator system, the counterweight is equipped with three pairs of guiding elements, able to switch over the guide shoes of the elevator car. This means that when a first pair of the switchable guiding elements meets the deflecting means, the second and the third pair of switchable guiding elements still accomplish a secure hold and safe run of the counterweight along the guide rails. As the movement of the counterweight continues against the opposite movement of the elevator car, the second pair of switchable guiding elements is deflected by the deflecting means, whilst the first and the third pair of switchable guiding elements guarantee the secure hold, and so on.

The deflecting means include, for example, at least one or several deflection blades or deflection keys, which are, according to a first embodiment, fixedly installed at or onto the guide shoes of the elevator car or on the elevator car.

Furthermore, considering the fact that the elevator car and the counterweight will generally meet at normal operating conditions always at one steady crossing point within the complete lifting height—normally at the middle of it—it is also possible to install the deflection blades or appropriate deflection keys fixedly in the elevator shaft. This second embodiment can have the advantage that in the elevator car or in its guide shoes no impact occurs, when the guide shoes of the elevator car and the guiding elements of the counterweight clash, as would happen in the first embodiment. Even if this clash is diminished by appropriate deflecting angles and/or damping materials, it possibly could constrain the quiet and safe travel of passengers in the elevator car.

The switchable guiding elements are mounted on a pivot and/or a joint, permitting them, possibly spring-biased, to have at least two different positions. One of the positions accomplishes the hold of the counterweight on the guide rail, whilst the other position ensures the safe collision-avoiding passing of the guide shoes of the elevator car and the switchable guiding elements of the counterweight. Furthermore, the switchable guiding elements possibly possess appropriate surfaces providing an automatic switch into the free and deflected position and back into the holding position. These appropriate surfaces interact with according contact surfaces on the deflecting elements.

An alternative solution of switchable guiding elements for the counterweight implements the at least two positions by prescribing a longitudinal movement, preferably from a first latching position to a second latching position, which could be both again spring-biased.

As the elevator car and the counterweight usually meet at a steady crossing point, disclosed herein is a further embodiment, which exhibits deflecting means in the shape of a separate deflecting rail for the whole counterweight itself. Still, the trajectory of the elevator car is straight due to straight vertical guide rails commonly used with the counterweight, but only the counterweight prescribes a deflecting or avoiding maneuver at the crossing point.

The elevator shaft according to this latter solution can offer a complete utilization of its cross-section for the elevator car and only requires in the middle a part of approximately two to four floors of the building for the deflecting rail. Thus, the taller the building or the elevator system is, the more advantageous in its costs it can be.

The counterweight according to this latter solution is possibly constituted of several weight parts linked together by joints or at least by partially pivoting links, so that the deflection from the straight guide rails performs smooth, even at high operating speeds of the elevator system.

The suspending and driving means, suspending the counterweight, are hereby possibly deflected by deflection pulleys and possibly arranged in between the pair of common guide rails. Another possible solution is to make the counterweight slightly larger than the elevator car and to fix the counterweight either with one or two suspending and driving means at one or two corners, which extend beyond the physical dimensions of the elevator car. Furthermore, the traction sheave or the traction sheaves are preferably arranged obliquely.

In order to deflect the counterweight onto the deflecting rails, pursuant to a further possible deflection solution of the present technologies, at least one or two pairs of mirror-inverted switch tongues initiate the deflection. The upper switch tongue or the upper switch tongues are installed adjacent to the main and straight guide rail above the crossing point or better said above the crossing region and guarantee the deflection of the counterweight when moving downwards. The lower switch tongue or the lower switch tongues in turn are installed mirror-inverted adjacent to the main and straight guide rail and provide the deflection of the counterweight onto the deflection rails when the counterweight is moving upwards. Therefore, the switch tongues have first inclined surfaces, which correspond to interacting inclined surfaces of the guiding elements of the counterweight.

Furthermore, the switch tongues are spring-biased pivotable and shaped in such manner, that second inclined surfaces of these switch tongues correspond with interacting inclined surfaces of the guide shoes of the elevator car only, and not with the above-mentioned interacting inclined surfaces of the guiding elements of the counterweight. Thus, automatic and safe passing of the elevator car of the switch tongues is achieved, guaranteeing the disposition of the elevator car on the main and straight guide rails and the compulsive deflection of the counterweight onto the deflection rails each time it enters the crossing region.

A second deflection solution according to an elevator system according to the disclosure is less complicated and thus less expensive and provides also a deflecting rail for the counterweight. Pursuant to this second solution, one of the guide rails of the single pair of guide rails is vertically straight and guides the elevator car with one or several corresponding guide shoes. The second guide rail of the pair of guide rails in turn is not completely straight, but follows the deflecting curvature within the crossing region. This second guide rail guides the counterweight. In between these first and second guide rails a core or a rigid and double frog is disposed. The elevator car and the counterweight pass this rigid and double frog with flat cylindrical rollers or special rollers that grasp L- or C-shaped guide rails only from one lateral side of the respective guide rail. The double frog has a rail, which is parallel to the straight guide rail for the elevator car, and another rail, which is parallel to the curved guide rail for the counterweight.

It is possible to install additional guide rails for improving the guided hold of the elevator car and the counterweight, for example at least at the crossing region. Furthermore, it is possible to install rollers or wheels, running not on rails, but on plane surfaces of the elevator shaft side walls.

It is a requirement that a collision of the elevator car and the counterweight must not happen. Thus, for additional safety reasons, an elevator system according to the present disclosure may have safety means, possibly mechanical ones, which stop the elevator car and/or the counterweight, as soon as it would enter the crossing region on the wrong guide rail. Such deployments or so called catching brakes are generally known by persons skilled in the art.

BRIEF DESCRIPTION OF THE FIGURES

The technologies are described in detail with reference to the accompanying drawings wherein.

DETAILED DESCRIPTION

In the figures, identical reference numbers denote the same component part or identical component parts whereas reference numbers with different indices denote similar component parts.

Figure 1:
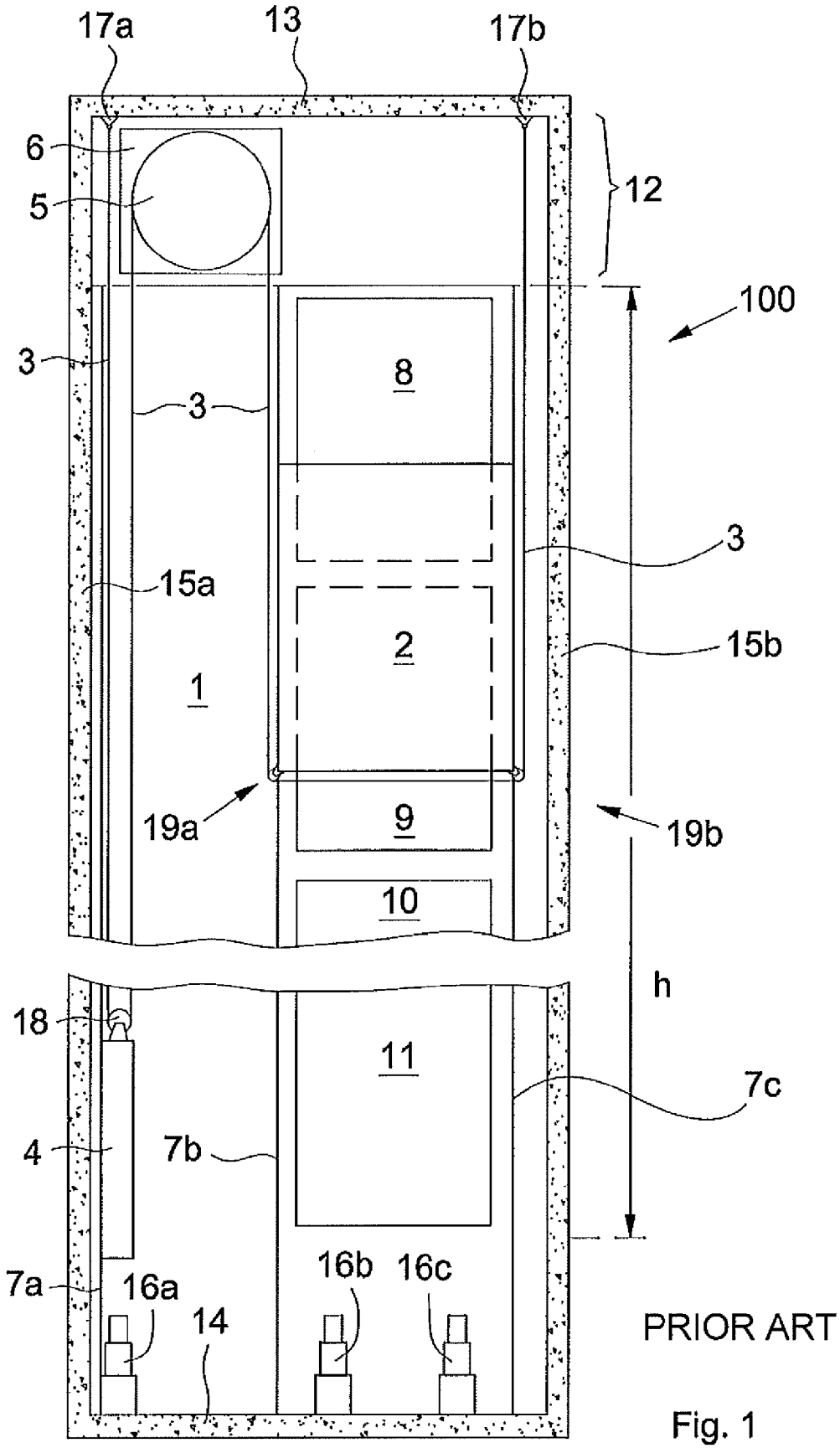
PRIOR ART Fig. 1
FIG. 1 is a schematic view of an exemplary elevator system with several pairs of guide rails according to the prior art.

FIG. 1 shows a conventional elevator system 100, as it is known from the prior art, having a 2:1 roping arrangement. In an elevator shaft 1 an elevator car 2 is arranged vertically displaceable and connected by a suspending and driving means 3 to a vertically displaceable counterweight 4. The suspending and driving means 3 is driven by a traction sheave 5 of a driving unit 6, which is arranged in the top region of the elevator shaft 1 in a machine room 12. The counterweight 4 is guided along a pair of guide rails 7*a* (only the front guide rail being depicted in FIG. 1) and similarly the elevator car 2 is guided along a pair of guide rails 7*b* and 7*c* which extend over the entire shaft height.

The travel path of the elevator car 2 is defined by the lifting height h from a landing door on the bottom floor 11 to a landing door on the top floor 8 with intermediate further landing doors 9 and 10. The elevator shaft 1 is composed of side walls 15*a* and 15*b*, a ceiling 13 and a pit 14. On the latter sits a pit buffer 16*a* for the counterweight 4 and two pit buffers 16*b* and 16*c* for the elevator car 2.

The suspending and driving means 3 is fixed to the ceiling 13 at a first fixed-point 17*a* and led parallel to the side wall 15*a* to an idler pulley 18 mounted on the counterweight 4. From here it is led back over the traction sheave 5, to a first pulley 19*a* and a second pulley 19*b*, forming an undersling for the elevator car 2, and to a second fixed-point 17*b* on the ceiling 13.

Figure 2:
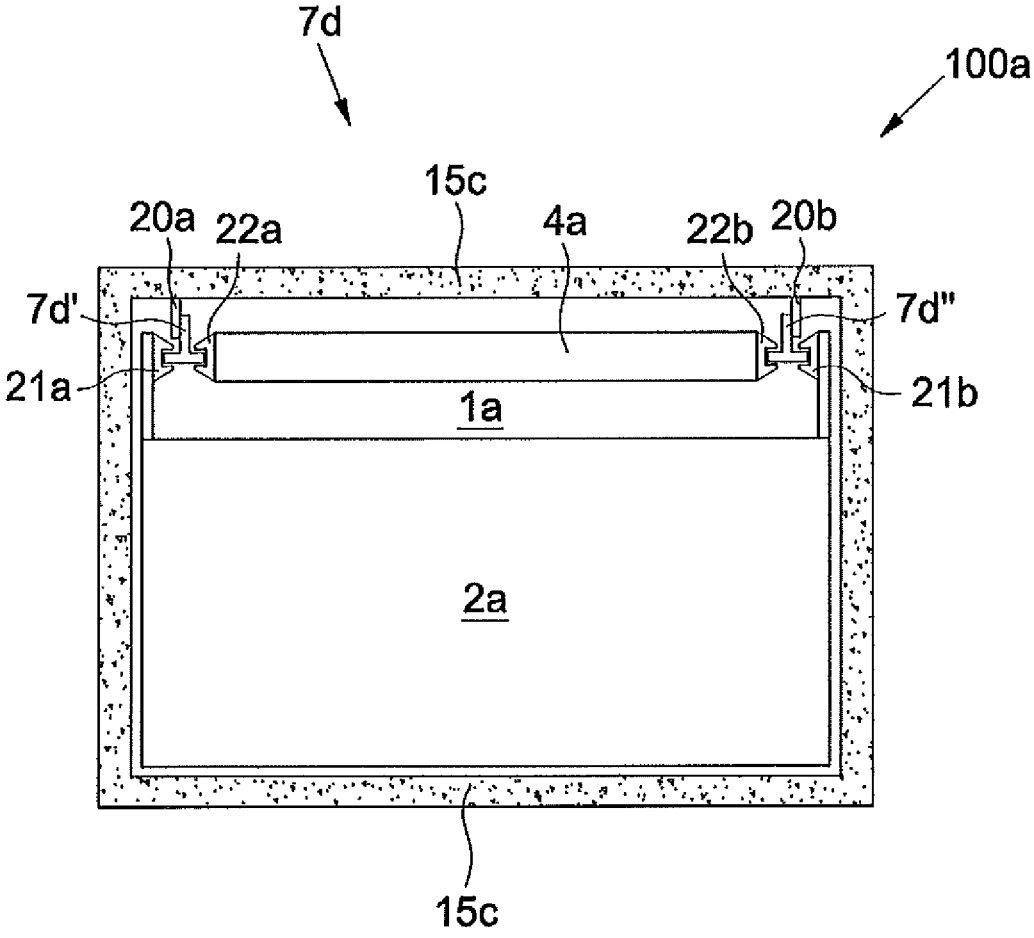
PRIOR ART Fig. 2
FIG. 2 is a schematic view of an elevator system with one pair of T-shaped guide rails according to the prior art.

FIG. 2 shows schematically a top view of an elevator system 100*a* according to the prior art as previously summarized with reference to DE-A1-44 23 412. A single pair of guide rails 7*d* is provided wherein two separate T-shaped guide rails 7*d*' and 7*d*" are fixed by a bracket 20*a* and 20*b*, respectively, to an elevator shaft wall 15*c*. The cross members of the T-shaped guide rails 7*d*' and 7*d*" are aligned so as to form interior guiding surfaces for guiding elements 22*a* and 22*b* mounted on a counterweight 4*a* positioned between the guide rails 7*d*' and 7*d*" and remote exterior guiding surfaces for guiding elements 21*a* and 21*b* mounted on an elevator car 2*a*. It can be seen, that a considerable part of the cross-section of the elevator shaft 1*a* is occupied by the counterweight 4*a*, so that the cross-section of the elevator car 2*a* utilizes only approximately two thirds of the cross-section of the elevator shaft 1*a*. Furthermore, although unified in T-shaped rails, the elevator car 2*a* and the counterweight 4*a* still use distinct and separate guiding surfaces. Thus, the elevator system 100*a* has no deflecting elements for deflecting guiding elements of the counterweight 4*a* and there are no common guiding surfaces used at the same time by the elevator car 2*a* and the counterweight 4*a*, as in the technologies depicted in the following figures.

Figure 3:
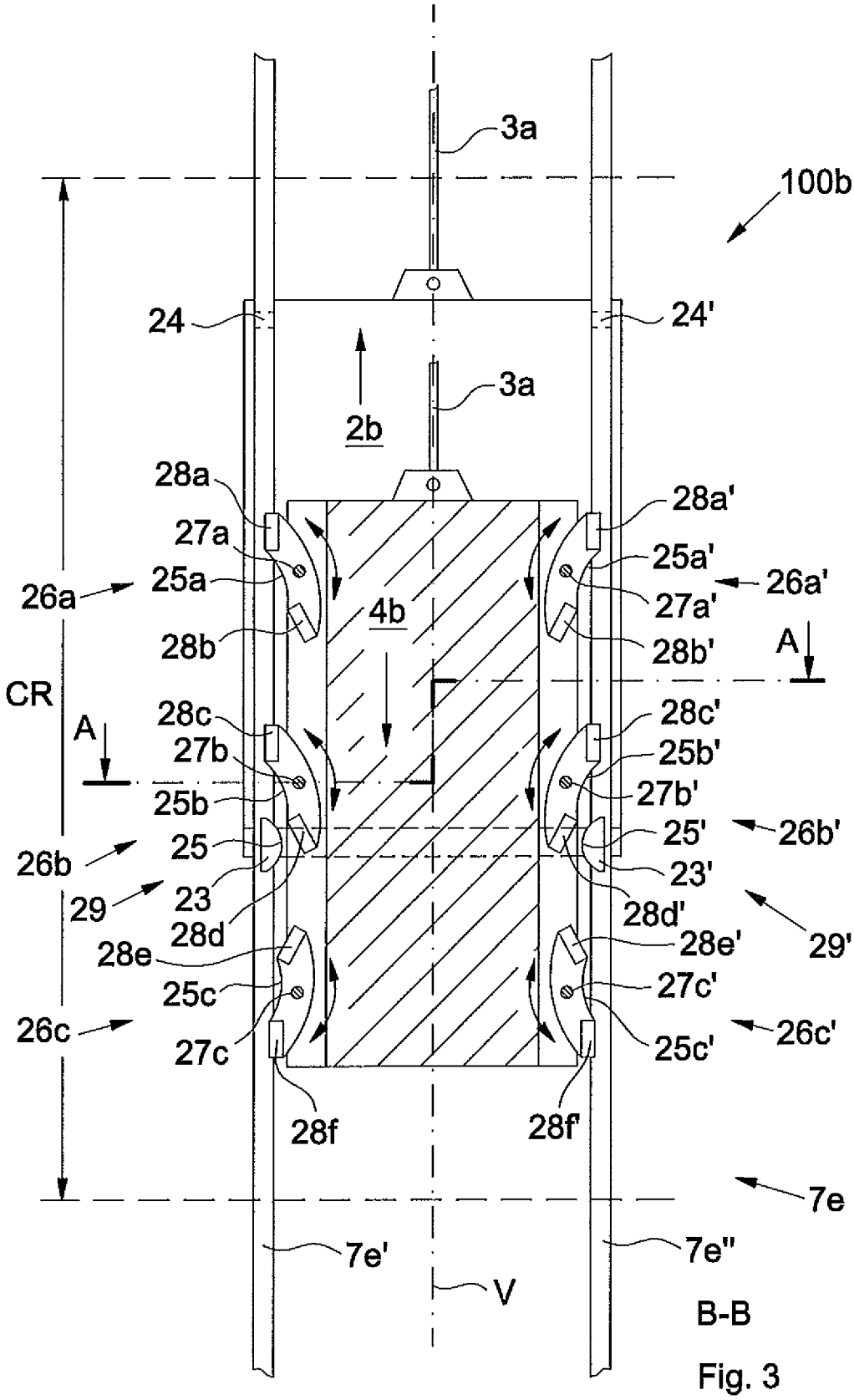
FIG. 3 is a schematic view of a first embodiment of an elevator system according to the disclosed technologies with a deflection element in the shape of a contact surface interacting with switchable guiding elements of the counterweight.

FIG. 3 shows a first embodiment of an elevator system 100*b* according to the present technologies, in which an elevator car 2*b* and a counterweight 4*b* use a common pair of guide rails 7*e*, constituted of a first guide rail 7*e*' and a second guide rail 7*e*". The counterweight 4*b* and the elevator car 2*b* are supported by a suspending and driving means 3*a*. The elevator car 2*b* runs along the guide rail 7*e*' with a guide shoe 23 and with a freely supported roller 24 and along the opposite guide rail 7*e*" with a guide shoe 23' and a freely supported roller 24'. The guide shoes 23 and 23' define a contact surface 25 and 25', respectively, capable of reciprocal contact with contact surfaces 25*a*-25*c* and 25*a*'-25*c*' of switchable guiding elements 26*a*-26*c* and 26*a*'-26*c*', respectively. Each of the guiding elements 26*a*-26*c* and 26*a*'-26*c*' show an upper guide 28*a*, 28*c*, 28*e*, 28*a*', 28*c*', 28*e*' and a corresponding lower guide 28*b*, 28*d*, 28*f*, 28*b*', 28*d*', 28*f*', respectively. The guide shoe 23 of the elevator car 2*b* with its contact surface 25 represents a deflecting element 29 for the switchable guiding elements 26*a*-26*c* of the counterweight 4*b* and the guide shoe 23' with its contact surface 25' represents a deflecting element 29' for the switchable guiding elements 26*a*'-26*c*' of the counterweight 4*b*. The switchable guiding elements 26*a*-26*c* and 26*a*'-26*c*' are mounted possibly as three corresponding pairs 26*a*-26*a*', 26*b*-26*b*', 26*c*-26*c*' of such switchable guiding elements, with pivots 27*a*-27*c* and 27*a*'-27*c*' on the counterweight 4*b*, but an offset placement of the guiding elements 26*a*-26*c* and 26*a*'-26*c*' is also possible.

The freely supported rollers 24 and 24' can optionally be guide shoes but of smaller dimensions to guide shoes 23 and 23'. The rollers or the smaller guide shoes cannot initiate a switching movement of the switchable guiding elements 26*a*-26*c* and 26*a*'-26*c*'. Otherwise the first guide shoe of the elevator car 2*b* would switch the first switchable guiding element into a position which would cause a collision with the second guide shoe of the elevator car 2*b*.

Respective arrows indicate an exemplary movement of the elevator car 2*b* upwards and of the counterweight 4*b* downwards. As the elevator car 2*b* and the counterweight 4*b* pass or cross in a crossing region CR in this manner, the lowermost pair of switchable guiding elements 26*c* and 26*c*' on the counterweight has already come into contact with the contact surfaces 25 and 25' of the opposing guide shoes 23 and 23' mounted on the car and switched from a position, where the guidance of the counterweight 4*b* on the guide rails 7*e*' and 7*e*" was accomplished by the upper guides 28*e* and 28*e*' and is now accomplished by the lower guides 28*f* and 28*f*'. The intermediate switchable guiding elements 26*b* and 26*b*' and afterwards the uppermost switchable guiding elements 26*a* and 26*a*' fulfill the same switching movement, as they pass the guide shoes 23 and 23' of the elevator car 2*b*, respectively. The switching of the switchable guiding elements 26*a*-26*c* and 26*a*'-26*c*' out of the position, where the upper guides 28*a*, 28*c*, 28*e* and 28*a*', 28*c*', 28*e*' guide the counterweight 4*b* into the position, wherein the lower guides 28*b*, 28*d*, 28*f* and 28*b*', 28*d*', 28*f*' guide the counterweight 4*b* and vice versa, is possibly enhanced by one or more springs, which are not depicted in detail.

The indicated arrangement of three pairs 26*a*-26*a*', 26*b*-26*b*', 26*c*-26*c*' of switchable guiding elements is sometimes preferred, so that two pairs maintain the guidance of the counterweight 4*b*, while one of the pairs can carry out its switching movement. Furthermore, it is possible to vertically offset the pair of guide shoes 23 and 23' of the elevator car 2*b* so that the two single switchable guiding elements of one pair of switchable guiding elements are not switched simultaneously. With deferred switching moments two pairs of switchable guiding elements instead of three suffice. Having four switchable guiding elements, only one switchable guiding element switches at a time, whilst the remaining three still guide the counterweight 4*b*.

Furthermore, the guides 28*a*-28*f* and 28*a*'-28*f*' are possibly interacting with the pair of guide rails 7*e* in form-locking manner.

Figure 3A:
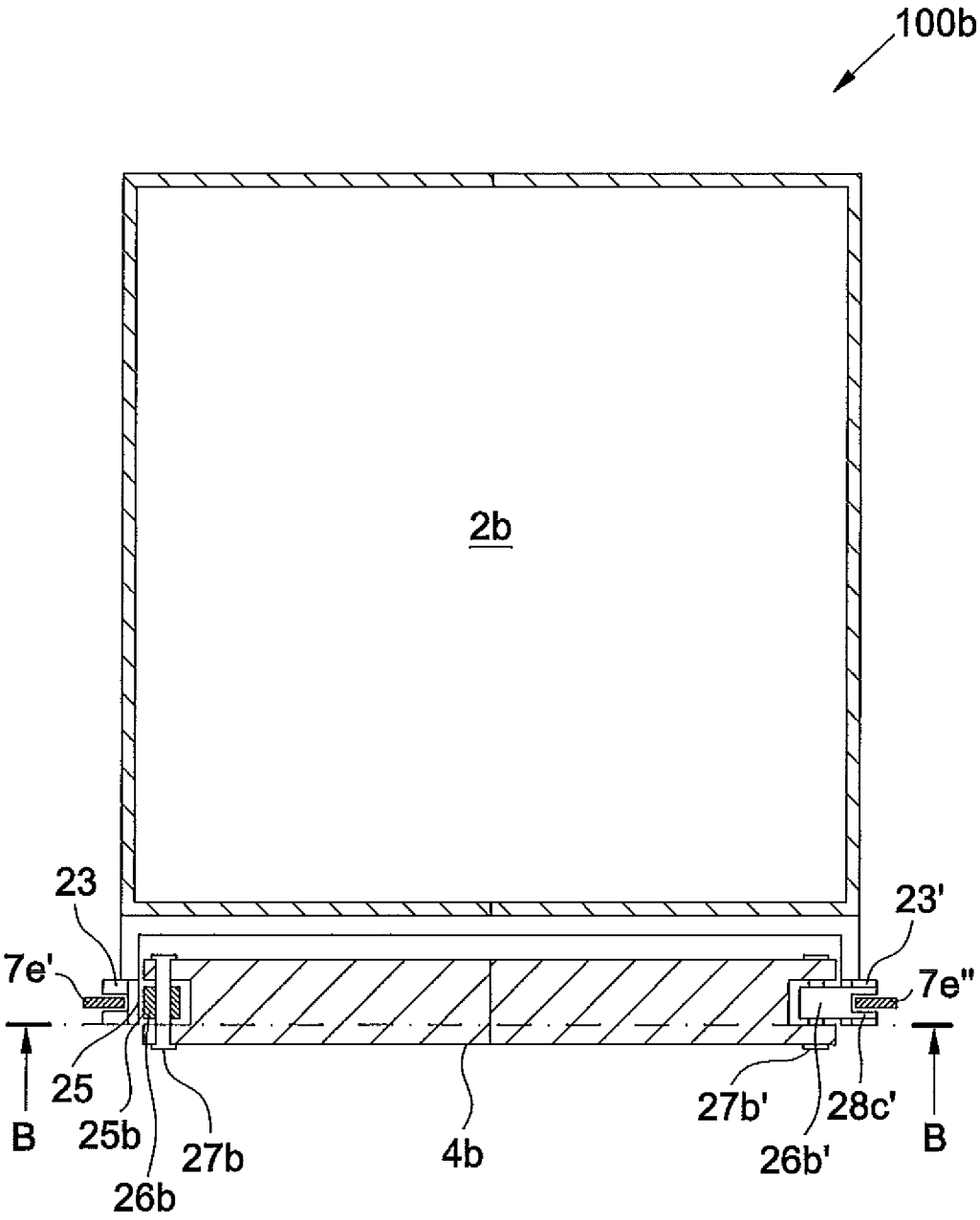
FIG. 3*a* is a sectional view of the first embodiment of an elevator system of FIG. 3.

FIG. 3*a* shows a sectional view from above of the elevator system 100*b* presented in FIG. 3, along a sectional line A-A. It can be seen, that the counterweight 4*b* is possibly placed longitudinally in between the guide rails 7*e*' and 7*e*" and the elevator car 2*b* is guided by C-shaped guide shoes 23 and 23' on the same guiding surfaces of the guide rails 7*e*' and 7*e*". A section line B-B refers to the sectional view of FIG. 3.

Figure 4:
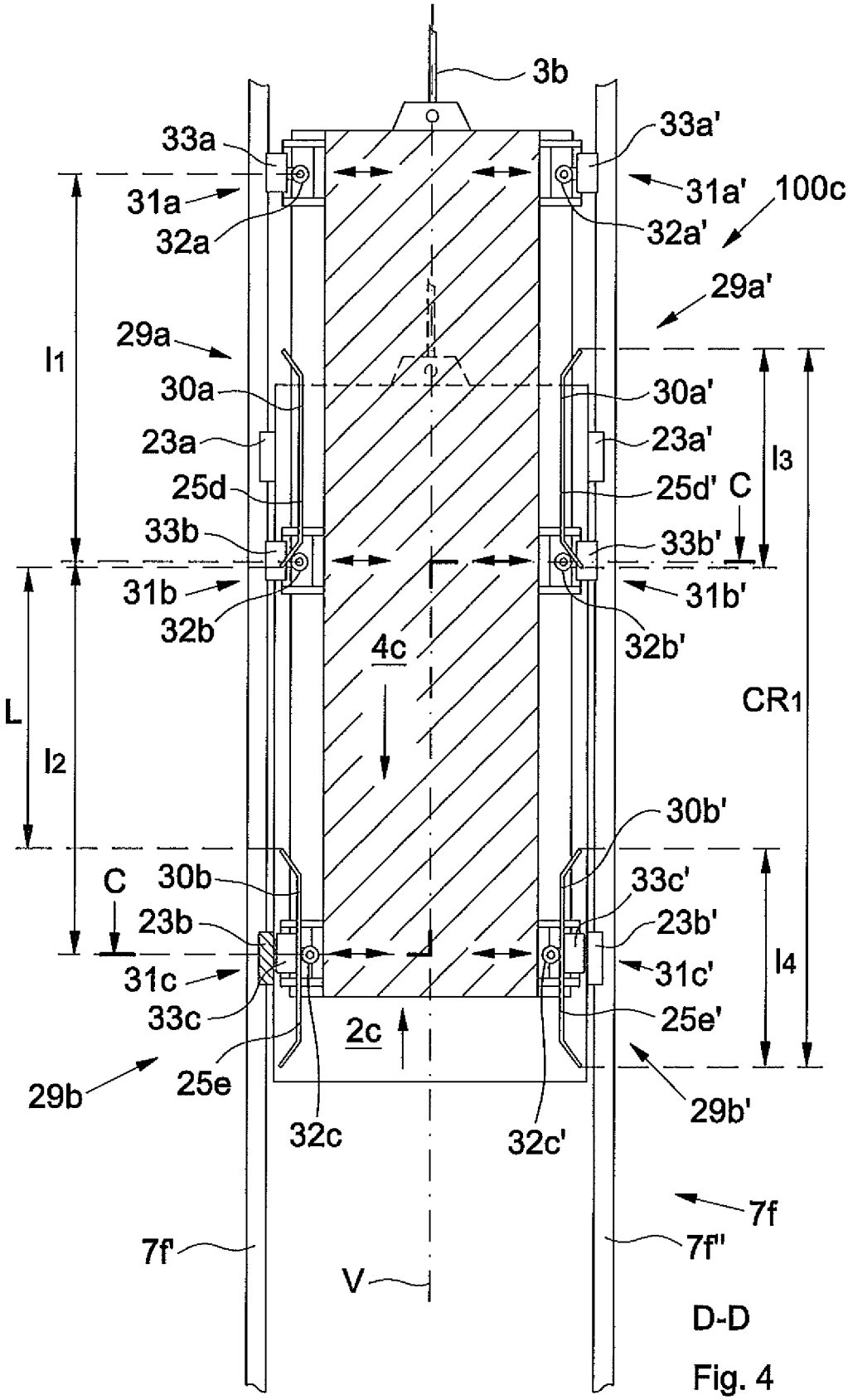
FIG. 4 is a schematic view of a second embodiment of an elevator system according to the disclosed technologies with a deflection element in the shape of a deflection blade interacting with longitudinally translating guiding elements of the counterweight.

In FIG. 4 it is schematically shown, how an exemplary further arrangement of an elevator system 100*c* according to the present technologies works with four deflection elements 29*a*, 29*b*, 29*a*' and 29*b*' in the shape of a deflecting blade 30*a*, 30*b*, 30*a*' and 30*b*', which are mounted either to the elevator car 2*c* or fixedly mounted to a side wall of the elevator shaft, but adjacent to a pair of guide rails 7*f* constituted by a first guide rail 7*f*' and a second guide rail 7*f*". Supported by a suspending and driving means 3*b*, an elevator car 2*c* and a counterweight 4*c* move in opposite directions, as indicated with arrows, along the pair of guide rails 7*f* guided on the latter with guide shoes 23*a*, 23*b*, 23*a*' and 23*b*' for the elevator car 2*c*, and with guiding elements 33*a*-33*c* and 33*a*'-33*c*' for the counterweight 4*c*. As already mentioned before, the described guiding means are possibly accomplished as symmetrical pairs 30*a*-30*a*', 30*b*-30*b*', 33*a*-33*a*', 33*b*-33*b*', 33*c*-33*c*'. The guiding means may also be arranged in a non-symmetrical way, e.g., with an offset.

The guiding elements 33a-33c and 33a'-33c' constitute together with deflection rollers 32a-32c and 32a'-32c' translating or longitudinally slidable guiding elements 31a-31c and 31a'-31c', slidable in an approximately horizontal direction, as indicated by double arrows, when the deflecting rollers 32a-32c and 32a'-32c' come into contact with a contact surface 25d of the deflection blade 30a or with a contact surface 25e of the deflection blade 30b or with a contact surface 25d' of the deflection blade 30a' or with a contact surface 25e' of the deflection blade 30b', respectively. As shown, the uppermost translating guiding element pair 31a and 31a' have not yet been deflected by the blades, the intermediate translating guiding elements 31b and 31b' have just terminated their horizontal deflection movement with blades 30a and 60a' and have returned to their original positions, and the lowermost translating guiding elements 31c and 31c' have been fully deflected by blades 30b and 30b'.

The vertical distance L between deflection blades 30a, 30b and 30c should not correspond to the vertical distances $l_1$ and $l_2$ between the neighboring translating guiding elements 31a, 31b and 31c, respectively, otherwise permanent guidance of the counterweight 4c by at least two pairs of translating guiding elements would not be implemented.

Furthermore, the deflection blades 30a, 30a' and 30b, 30b' need to have a sufficient length $l_3$ and $l_4$ to take into consideration the speed at which the elevator car 2c is moving. For this reason, as an alternative, a third or even a fourth pair of deflection blades can be installed. The upper end of the topmost deflection blades—in the depicted case the deflection blades 30a and 30a'—and the lower end of the bottom deflection blades—in the depicted case the deflection blades 30b and 30b'—constitute the beginning and the end of a crossing region $CR_1$. Within the crossing region $CR_1$, the lengths L, 11-14 must be correlated correctly so as to avoid collisions between the guide shoes 23a, 23b, 23a', 23b' of the elevator car 2c and the translating guiding elements 31a-31c, 31a'-31c' of the counterweight 4c.

Figure 4A:
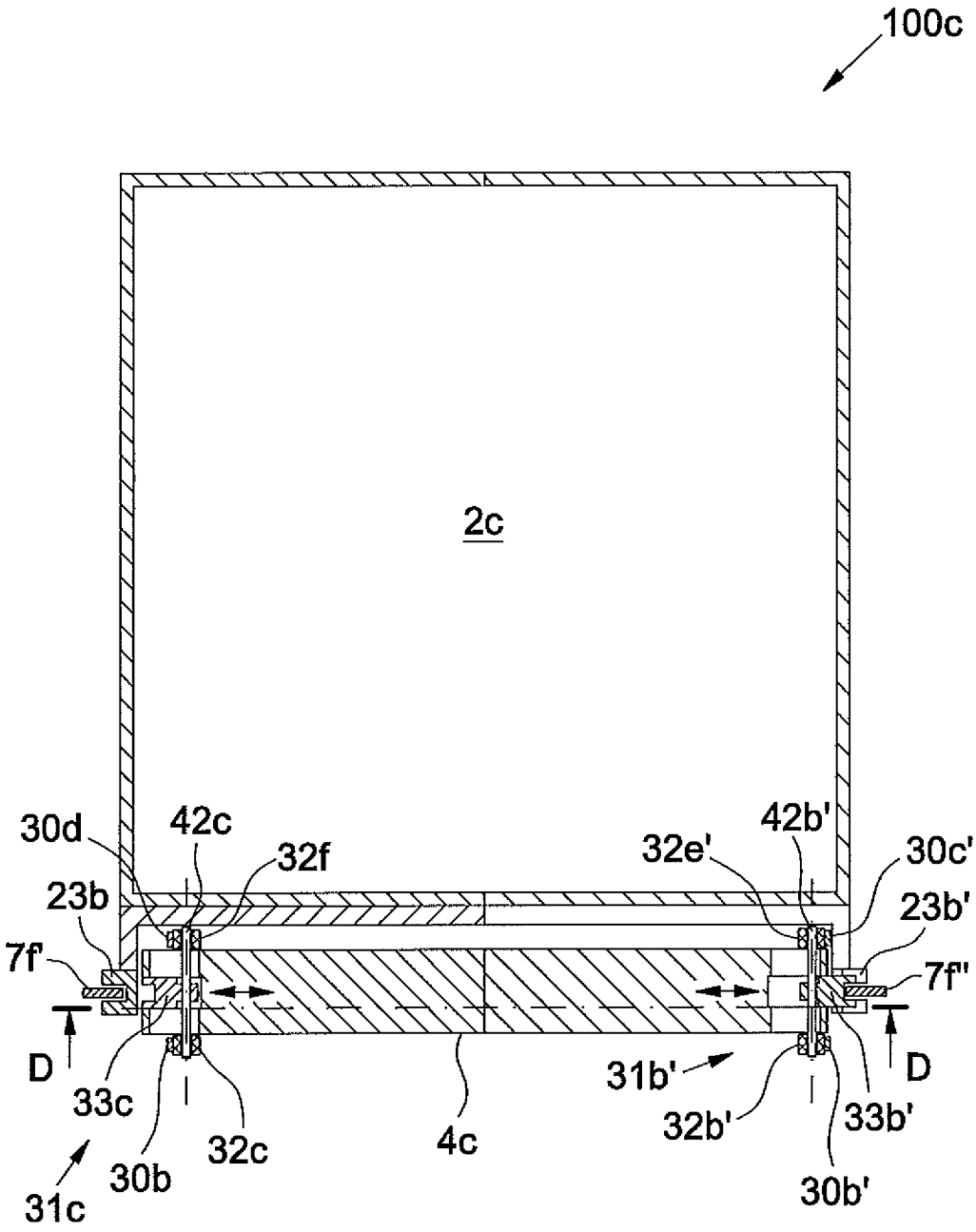
FIG. 4*a* is a sectional view of the second embodiment of an elevator system of FIG. 4.

The FIG. 4a shows the section along the section line C-C in the FIG. 4. Furthermore, as shown, each of the deflecting rollers 32c and 32b' is connected via an axle 42c and 42b' to a corresponding deflecting roller 32f and 32e' on the opposite side of the guide rail. Similarly each blade 30b and 30d has a counterpart 30b' and 30c' on the opposite side of the guide rail to deflect the corresponding deflecting roller 32f and 32e'. Line D-D refers to the sectional view of the preceding FIG. 4.

Figure 5:
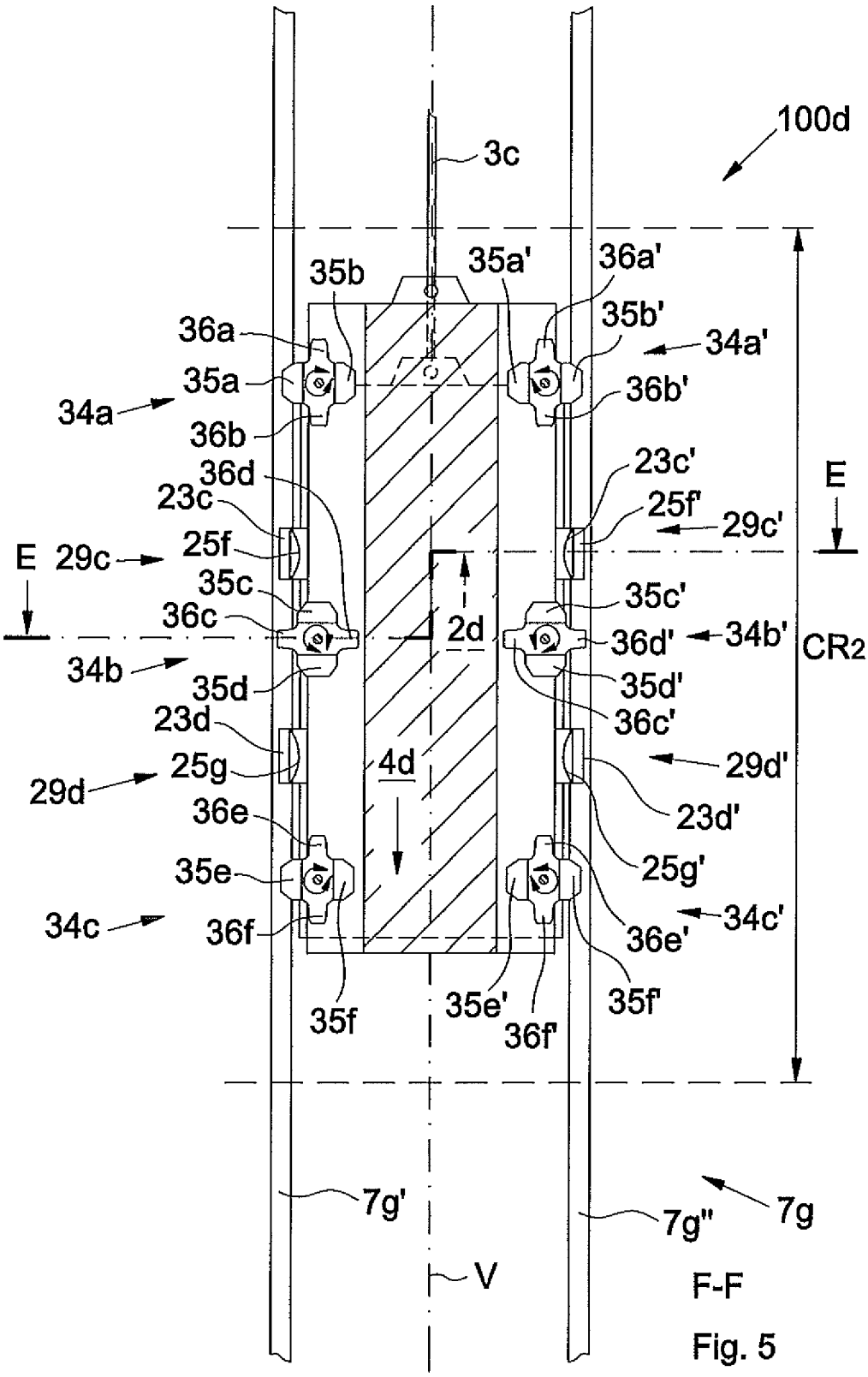
FIG. 5 is a schematic view of a third embodiment of an elevator system according to the disclosed technologies with a deflection element in the shape of a contact surface interacting with rotatable guiding elements of the counterweight.

FIG. 5 depicts a further embodiment of an elevator system 100d with rotatable guiding elements 34a-34c and 34a'-34c' for a counterweight 4d. An elevator car 2d and the counterweight 4d are supported by a suspending and driving means 3c and run both along the same pair of guide rails 7g, constituted by a first guide rail 7g' and a second guide rail 7g". The elevator car 2d is guided with guide shoes 23c, 23d, 23c' and 23d' which have contact surfaces 25f, 25g, 25f' and 25g'. The guide shoes 23c, 23d, 23c', 23d' represent together with their respective contact surfaces 25f, 25g, 25f', 25g' deflection elements 29c, 29d, 29c' and 29d' for the rotatable guiding elements 34a-34c and 34a'-34c' of the counterweight 4d.

The rotatable guiding elements 34a-34c and 34a'-34c' have opposing guides 35a-35f and 35a'-35f' and opposing extensions 36a-36f and 36a'-36f'. As the elevator car 2d and the counterweight 4d move as indicated by arrows past one another, the first contact surfaces 25f and 25f' of guide shoes 23c and 23c' turn the rotatable guiding elements 34a and 34a' by 90 degrees out of the depicted position into a position where the guides 35a and 35b' are free—i.e. into a position shown for rotatable guiding elements 34b and 34b'. In this latter position, none of the guides 35 are in action, so that this rotatable guiding element 34 temporarily plays no holding or guidance function for the counterweight. In order to keep this period short, it is possible to place the deflecting elements 29c, 29d, 29c', 29d' of the guide shoes 23c, 23d, 23c', 23d' of the elevator car 2d as near as possible to each other.

As the movement of the elevator car 2d and the counterweight 4d passing one another progresses, the second deflecting elements 29d and 29d' of the second guide shoes 23d and 23d' will come into contact with the extensions 36c and 36d' and turn the rotatable guiding elements 34b and 34b' again by 90 degrees into a position that the rotatable guiding elements 34c and 34c' previously had. In this latter position, the guides 35e and 35f' are in action.

The rotatable guiding elements 34a-34c and 34a'-34c' are able to rotate clockwise and counterclockwise, in order to work at an upwards-run of the elevator car 2d as well as at a downwards-run of it. The rotatable guiding elements 34a-34c and 34a'-34c' possibly have recesses or slots sustaining the deflection into defined positions of 0, 90, 180 and 360 degrees, preferably enhanced by spring-biased pins.

A crossing region $CR_2$ is schematically shown because the depicted arrangement of an elevator system 100d is not dependent on a certain crossing region, i.e., the elevator car 2d and the counterweight 4d could cross at any theoretical point in the elevator shaft. However, due to the constant length of the suspending and driving means 3c the crossing of the elevator car 2d and the counterweight 4d always takes place at the crossing region $CR_2$, which corresponds normally with a middle region of the elevator shaft.

Alternative embodiments of the described rotatable guiding elements 34a-34c and 34a'-34c' provide only one guide and thus only one guiding position, out of which the rotatable guiding element is rotated. A first variant of these alternative embodiments functions in combination with a spring, which pushes or pulls the rotatable guiding element back into its guiding position, as soon as it passes a contact surface. A second variant of these alternative embodiments operates with four reset pins, two installed above the deflecting elements 29c, 29c' and another two installed below the deflecting elements 29d, 29d', so that the rotatable guiding elements pass—describing an upwards-run of the elevator car 2d—the upper reset pins freely, are then turned by the first deflecting elements 29c and 29c' into the deflected position, pass due to this deflected position the second deflecting elements 29d and 29d' freely, and are then reset by the lower reset pins back into the guiding position. The reset pins are preferably fixedly mounted in the elevator shaft and interact for example with a bolt or a contact surface upon the rotatable guiding element, but only then, when the rotatable guiding element is in the deflected position.

Figure 5A:
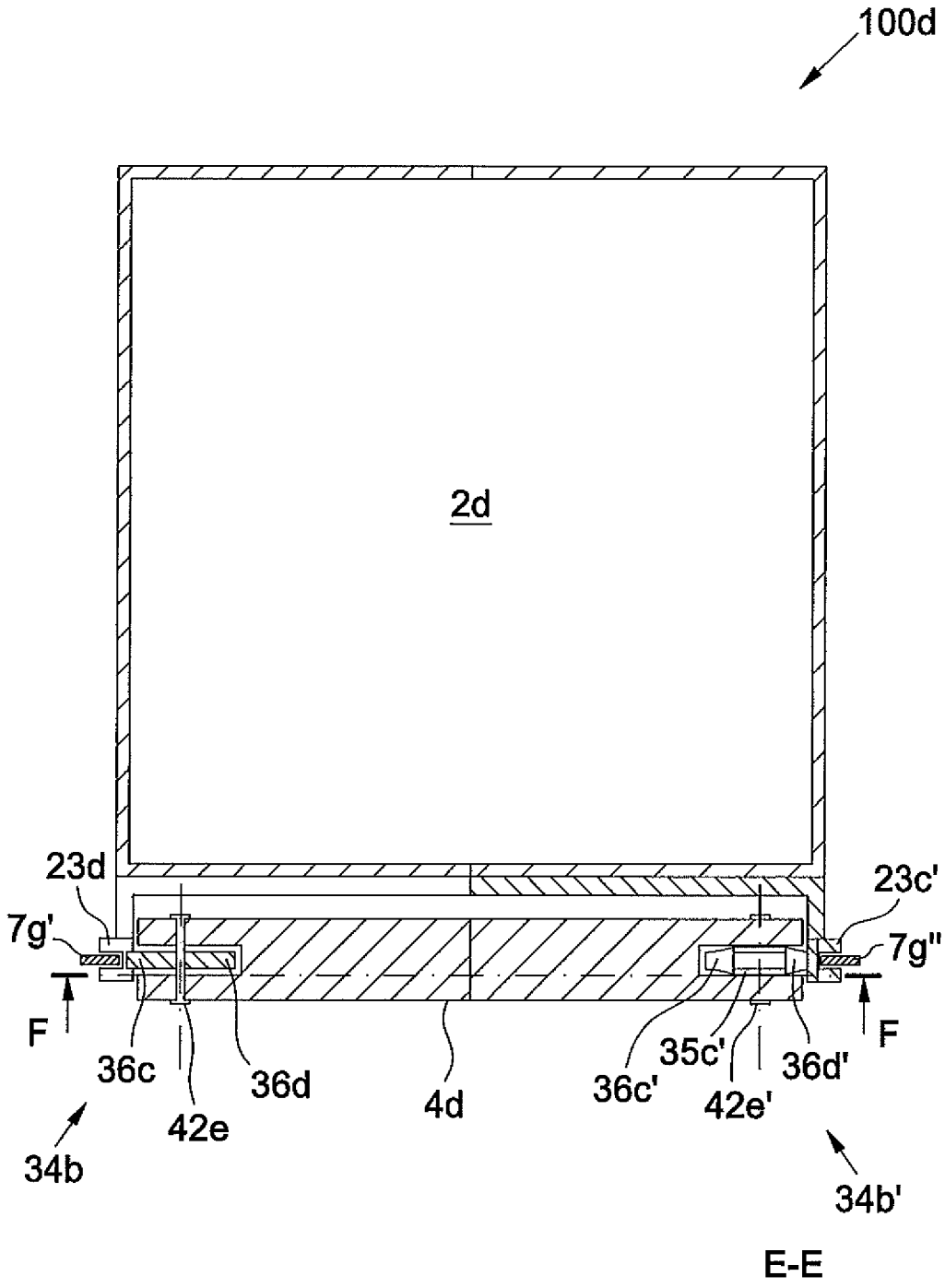
FIG. 5*a* is a sectional view of the third embodiment of an elevator system of FIG. 5.

FIG. 5a shows a sectional view of the elevator system 100d of FIG. 5 along a section line E-E. Exemplary for the other rotatable guiding elements it is shown that the rotatable guiding elements 34b and 34b' are possibly supported by an axle 42e and 42e'. A section line F-F explains the section surfaces in the preceding FIG. 5.

Figure 6:
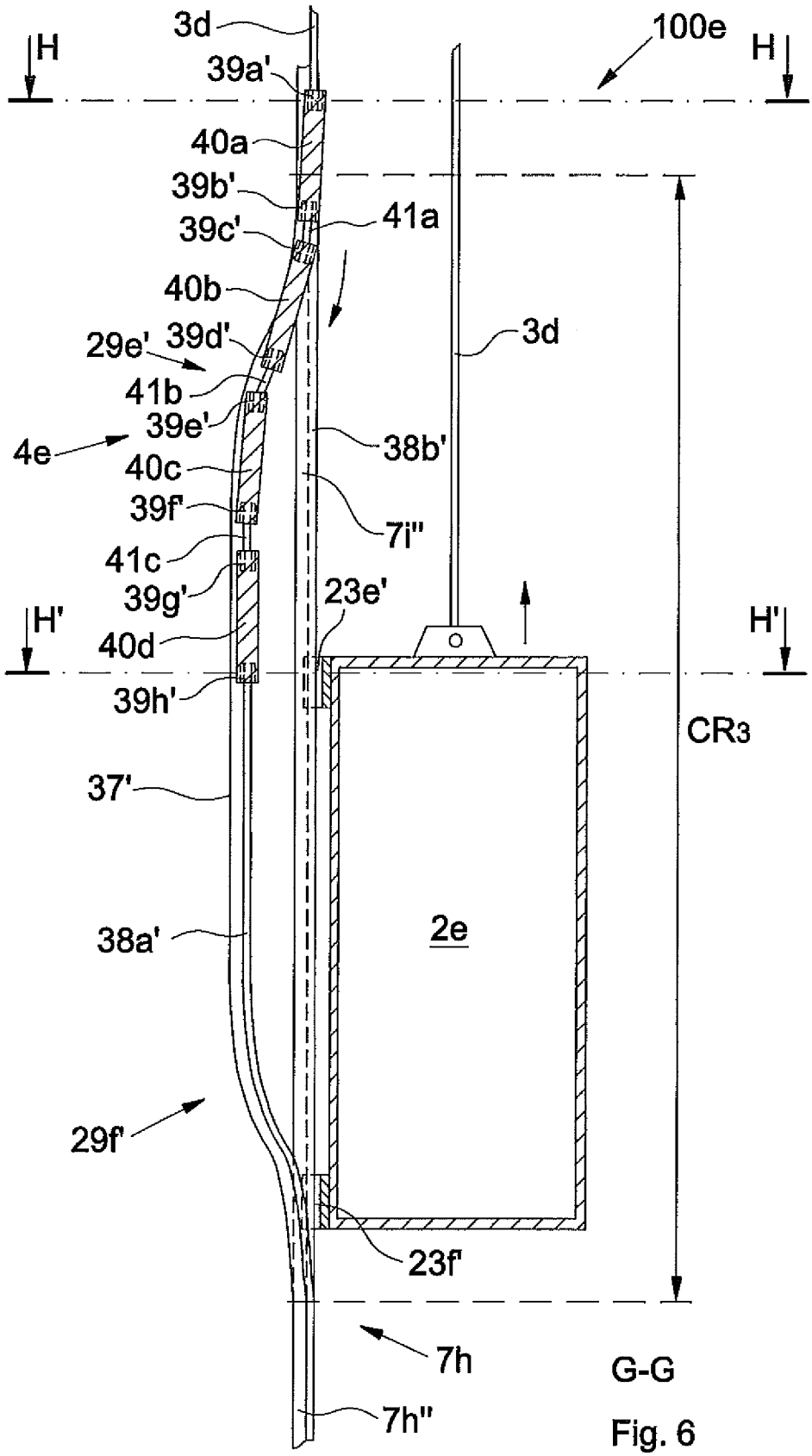
FIG. 6 is a schematic view of an embodiment of an elevator system with a deflection element in the shape of a deflecting rail for guiding elements of the counterweight.

FIG. 6 shows a fourth embodiment of an elevator system 100e according to the present technologies, with two deflecting elements 29e' and 29f' in the shape of a deflecting rail 37' for a counterweight 4e. Both the counterweight 4e and an elevator car 2e are supported by a suspending and driving means 3d, whereas the elevator car 2e and the counterweight 4e share beyond a crossing region $CR_3$ the same pair of guide rails 7h, of which the illustrated lateral and sectional view shows only a guide rail 7h" laying in the back. The elevator car 2e is shown while running with guide shoes 23e' and 23f' along a guide rail 71", which is within the crossing region $CR_3$, as well as beyond it, straight. The counterweight 4*e* has several weight parts 40*a*-40*d*, linked possibly by pivotable jointed links 41*a*-41*c*, and is shown while entering the deflecting rail 37'. Each of the weight parts 40*a*-40*d* is guided by two guiding elements 39*a*'-39*h*'. Both the deflecting rail 37' and the straight guide rails 7*h*" and 71" show guiding edges 38*a*' and 38*b*', providing an additional holding and guiding surface for the guide shoes 23*e*', 23*f*' and for the guiding elements 39*a*'-39*h*', which are possibly L- or C-shaped grasping the additional holding and guiding surface. As a matter of course the guide shoes 23*e*', 23*f*' and the guiding elements 39*a*'-39*h*' can be equipped with rollers.

As an alternative to the depicted elevator system 100*e* of FIG. 6, the compulsive deflection of the counterweight 4*e* works either with two mirror-invertedly arranged switch tongues interacting mechanically self-acting with adequate contact surfaces of the guiding elements 39*a*'-39*h*', or by splitting the double guidance of each the elevator car 2*e* and the counterweight 4*e*, or of only one of them up into a holding guidance on a single exterior rail and a free guidance on a double frog parallel to the deflecting curvature of the deflecting rail 37.

Figure 6A:
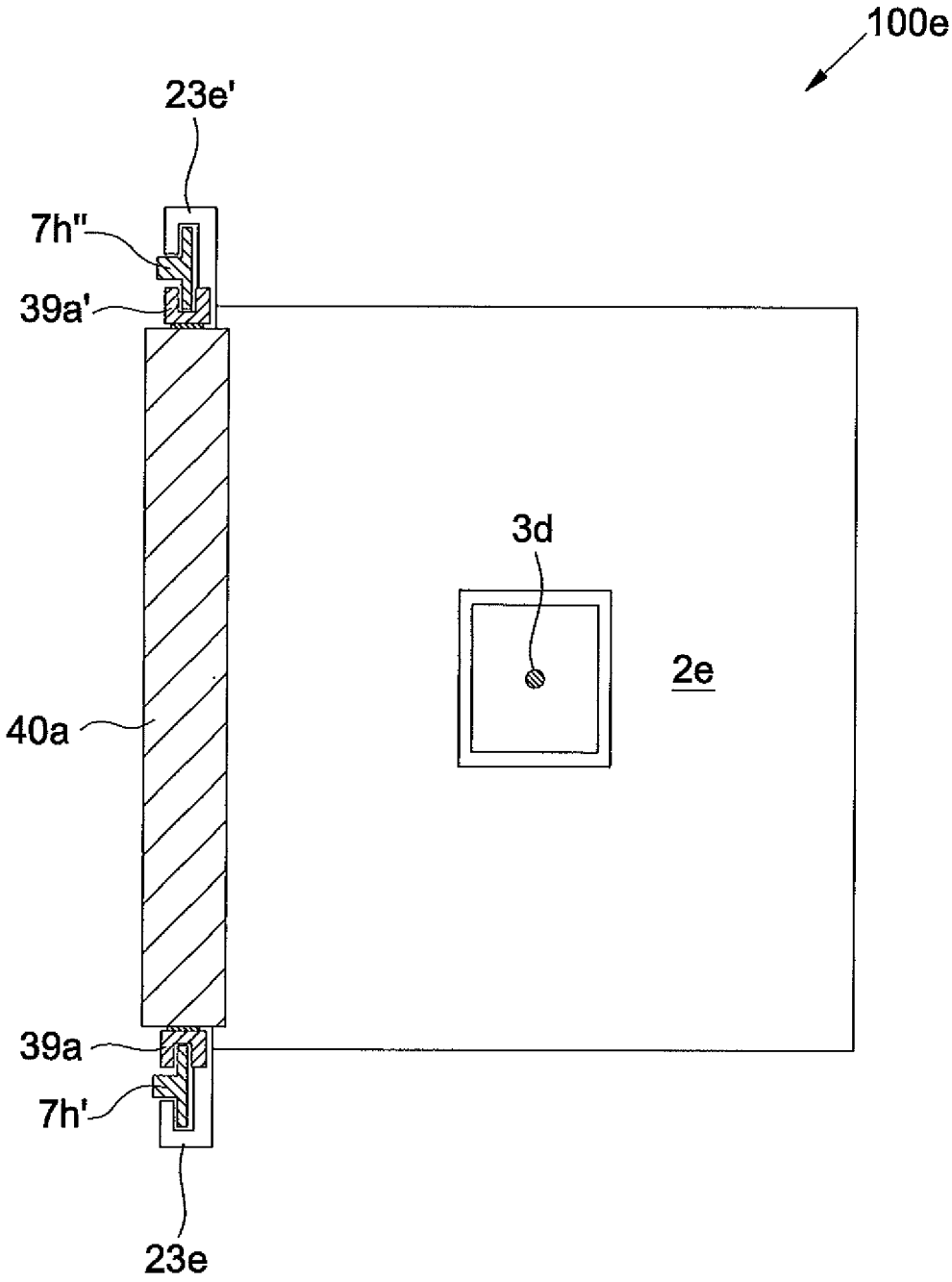
FIG. 6*a* is a first sectional view of the embodiment of an elevator system of FIG. 6

FIG. 6*a* shows a sectional view of the elevator system of FIG. 6, according to a first section line H-H. The counterweight 4*e*—depicted in this sectional view as the weight part 40*a*—and the elevator car 2*e* use both the guide rails 7*h*' and 7*h*".

Figure 6B:
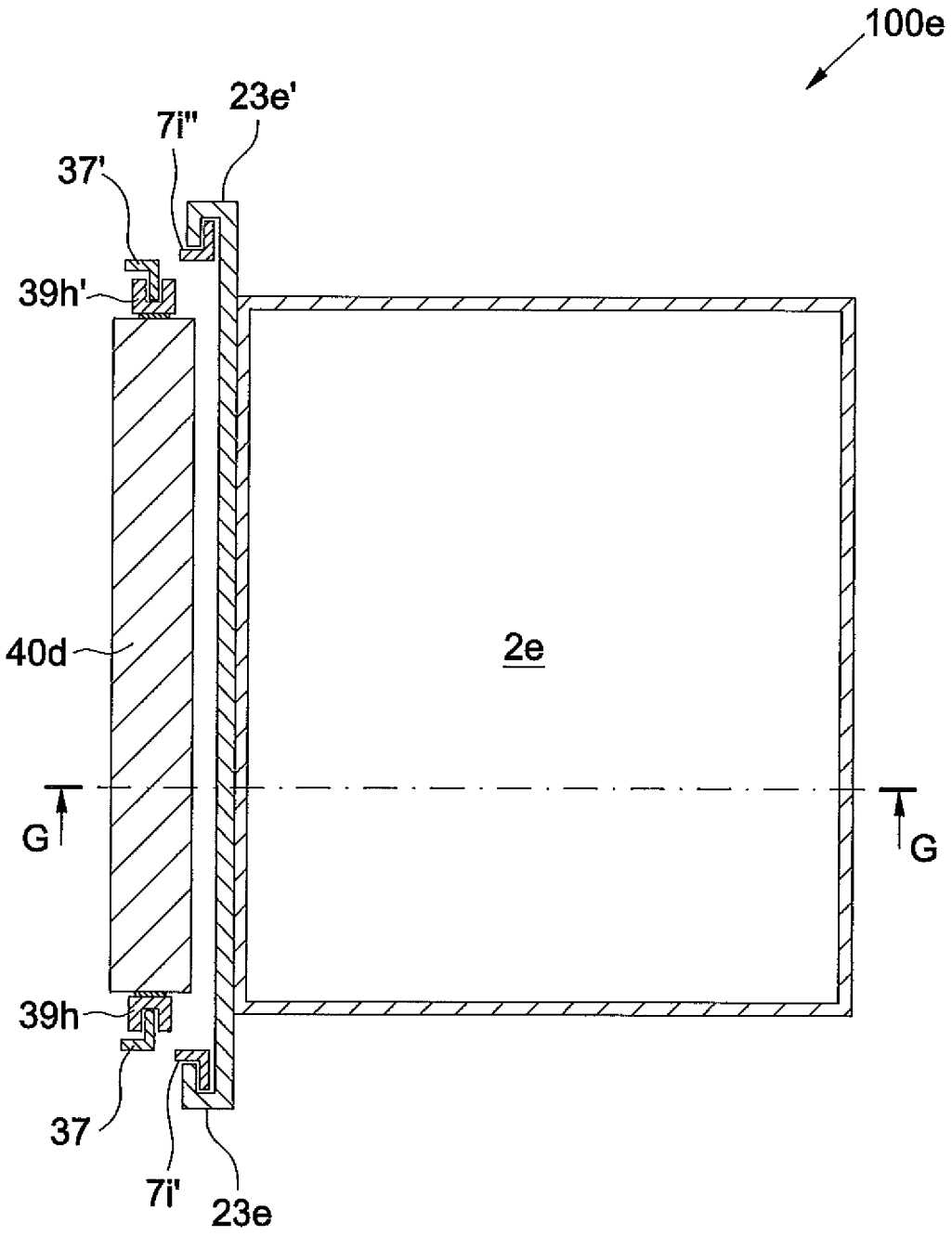
FIG. 6*b* is a second sectional view of the embodiment of an elevator system of FIG. 6.

FIG. 6*b* shows a sectional view of the elevator system of FIG. 6, according to a second section line H'-H'. The counterweight 4*e*—depicted in this second sectional view as the weight part 40*d*—has left within the crossing region $CR_3$ the common guide rails 7*h*' and 7*h*" and follows now the deflecting rails 37 and 37'. The elevator car 2*e* follows a straight guide rail 7*i*' and the straight guide rail 7*i*". A section line G-G explains the section surfaces shown in FIG. 6.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

I claim:

1. An elevator installation comprising:

an elevator car disposed in an elevator shaft;

a counterweight disposed in the elevator shaft;

at least one guide rail disposed in the elevator shaft;

one or more elevator car guide components configured to travel along the at least one guide rail, the one or more elevator car guide components being coupled to the elevator car;

one or more counterweight guide components configured to travel along and engage the at least one guide rail, the one or more counterweight guide components being coupled to the counterweight; and one or more deflecting components configured to at least partially deflect the one or more counterweight guide components away from engagement with the at least one guide rail.

2. The elevator installation of claim 1, wherein the one or more deflecting components comprise at least one deflecting rail.

3. The elevator installation of claim 2, wherein the counterweight comprises a plurality of connected weight parts.

4. The elevator installation of claim 1, wherein the one or more deflecting components comprise one or more guide shoes.

5. The elevator installation of claim 4, wherein the guide shoes are part of the one or more elevator car guide components.

6. The elevator installation of claim 1, wherein the one or more deflecting components are coupled to the elevator shaft.

7. The elevator installation of claim 1, wherein the one or more deflecting components comprise deflecting blades.

8. The elevator installation of claim 7, wherein the one or more counterweight guide components are configured to move perpendicularly relative to the at least one guide rail in response to the one or more deflecting components.

9. The elevator installation of claim 1, wherein the one or more counterweight guide components comprise one or more rotatable guiding elements.

10. The elevator installation of claim 9, the one or more deflecting components comprising a first deflecting component and a second deflecting component, wherein at least one of the one or more rotatable guiding elements is configured to be rotated to a deflected position by the first deflecting component and rotated to a guiding position by the second deflecting component.

11. The elevator installation of claim 9, the one or more rotatable guiding elements comprising respective opposing guides and respective opposing extensions.

12. The elevator installation of claim 1, wherein the one or more elevator car guide components and the one or more counterweight guide components are configured to travel along a common surface of the at least one guide rail.

13. The elevator installation of claim 1, wherein the one or more counterweight guide components comprise a plurality of counterweight guide components, and wherein the counterweight guide components are configurable such that at least one of the counterweight guide components is deflected away from the at least one guide rail while at least one of the counterweight guide components is not deflected away from the at least one guide rail.

14. The elevator installation of claim 1, wherein the one or more counterweight guide components are spring-biased for a guiding position and a deflected position.

15. An elevator method comprising:

moving an elevator car in an elevator shaft along at least one guide rail in a first direction, at least one car guide shoe engaging the at least one guide rail and the elevator car;

moving a counterweight in the elevator shaft along the at least one guide rail in a second direction, the second direction being opposite the first direction, at least one counterweight guiding element engaging the at least one guide rail and the counterweight;

while the elevator car and the counterweight are moving, at least partially disengaging the at least one counterweight guiding element from the at least one guide rail; and while the elevator car and the counterweight are moving, reengaging the at least one counterweight guiding element with the at least one guide rail.

16. The elevator method of claim 15, wherein the at least partially disengaging the at least one counterweight guiding element from the at least one guide rail comprises moving the at least one counterweight guiding element to another guide rail.

17. The elevator method of claim 15, the at least one counterweight guiding element comprising first and second counterweight guiding elements, wherein the first counterweight guiding element is at least partially disengaged from the at least one guide rail for at least a portion of the time that the second counterweight guiding element is engaged with the at least one guide rail.

18. An elevator apparatus comprising:

elevator car guide means for engaging an elevator car disposed in an elevator shaft and for engaging at least one guide rail disposed in the elevator shaft;

counterweight guide means for engaging a counterweight disposed in the elevator shaft and for engaging the at least one guide rail; and deflecting means configurable for moving at least a portion of the counterweight guide means away from engagement with the at least one guide rail.

19. The elevator apparatus of claim 18, the elevator car guide means comprising one or more guide shoes, the one or more guide shoes comprising respective curved contact surfaces.

20. The elevator apparatus of claim 18, the counterweight guide means comprising one or more rotating components.

* * * * *